US008016131B2

(12) United States Patent
Belokin et al.

(10) Patent No.: US 8,016,131 B2
(45) Date of Patent: Sep. 13, 2011

(54) DISPLAY TRAY

(75) Inventors: Paul Belokin, Denton County, TX (US); Martin P. Belokin, Denton County, TX (US); Norman P. Belokin, Denton County, TX (US)

(73) Assignee: Displays by Martin Paul, Inc.—Creative Center, Denton, TX (US)

( * ) Notice: Subject to any disclaimer, the term of this patent is extended or adjusted under 35 U.S.C. 154(b) by 1211 days.

(21) Appl. No.: 11/367,741

(22) Filed: Mar. 6, 2006

(65) Prior Publication Data

US 2007/0205167 A1 Sep. 6, 2007

(51) Int. Cl.

| | |
|---|---|
| ***A47B 73/00*** | (2006.01) |
| ***A47F 5/08*** | (2006.01) |
| ***A47F 3/14*** | (2006.01) |
| ***A47J 47/00*** | (2006.01) |

(52) U.S. Cl. ..... 211/75; 211/126.1; 211/88.01

(58) Field of Classification Search ..... 211/75, 211/86.01, 88.01, 90.01, 126.1, 126.2, 126.3, 211/126.4, 126.5; 108/65, 97, 152, 108; 220/751

See application file for complete search history.

(56) References Cited

U.S. PATENT DOCUMENTS

| | | | | |
|---|---|---|---|---|
| 3,647,078 | A * | 3/1972 | Fortunato | 211/134 |
| 4,828,121 | A * | 5/1989 | Willcocks, Jr. | 211/94.01 |
| 5,549,054 | A * | 8/1996 | Lewis | 108/152 |
| 6,907,829 | B2 * | 6/2005 | Bambach et al. | 108/65 |
| D551,953 | S * | 10/2007 | Smalley | D8/381 |
| 2002/0139808 | A1 * | 10/2002 | Grueneberg | 220/751 |

* cited by examiner

*Primary Examiner* — Katherine Mitchell
*Assistant Examiner* — Jeremy Ramsey
(74) *Attorney, Agent, or Firm* — Jack A. Kanz

(57) ABSTRACT

Tray units adapted to be mounted on and extend from the front edges of conventional display shelves for supporting and displaying merchandise are provided with mounting support means which attach the tray to the display shelf. The support means includes a first member which extends horizontally from the back side of the tray and a plurality of posts which depend from the first member and extend parallel therewith and rearwardly therefrom. The tray may be simply attached to and supported from the front edge of the shelf by inserting the posts into holes in the shelf so that the first member rests on the top surface of the shelf and the posts rest on the bottom surface of the shelf.

8 Claims, 3 Drawing Sheets

DISPLAY TRAY

This invention relates to methods and apparatus for holding and displaying merchandise or the like. More particularly, it relates to display shelves or trays adapted for mounting on the outer edges of conventional merchandise display shelves to support and display products within view and easy access for potential users.

Retail businesses such as grocery stores, convenience stores, etc., commonly arrange merchandise for sale on display shelves which support and display goods for sale at convenient locations so that the goods are attractive and easily accessible to potential customers.

Customers are more likely to buy goods which are displayed attractively and conveniently. However, as the number and variety of goods increases, use of display space must be maximized to appropriately display the maximum amount of goods. Accordingly, as retailers attempt to maximize visibility of products on display, conventional display methods and apparatus are modified and reconfigured in unconventional ways. However, such modifications must be inexpensive and provide reliable results to be economically practical.

Typically, apparatus for supporting and displaying merchandise comprises a plurality of horizontal parallel shelves supported in fixed relation to each other. Each shelf comprises a flat, thin sheet of rigid material such as steel or the like. Typically, each shelf includes a flange depending downwardly from the outer edge thereof to rigidly reinforce the shelf. This flange is often used as a support for graphic information, such as price, etc., relative to the goods displayed on the shelf. Most such shelves also have one or more rows of holes passing therethrough aligned parallel with and spaced from the outer or front edge of the shelf. These holes are generally used to support spacers or edge walls to contain or divide goods placed on the shelf. However, since conventional display shelves are usually pre-assembled large fixtures, they afford little opportunity for convenient modification or rearrangement to accommodate unique display arrangements.

In accordance with the present invention, display trays adapted to be mounted on and extend from the outer (front) edges of conventional shelves are provided which can be easily and readily added, removed and rearranged as desired. The display trays of the invention may be inexpensively and conveniently formed in various sizes and shapes to perform various specialized functions. Moreover, the display trays may be added, removed or rearranged quickly and conveniently without the use of any tools. The unique trays of the invention thus provide a highly desireable flexibility in display apparatus which is inexpensive and conveniently used. Other features and advantages of the invention will become more readily understood from the following detailed description taken in connection with the appended claims and attached drawing in which:

Figure 1:
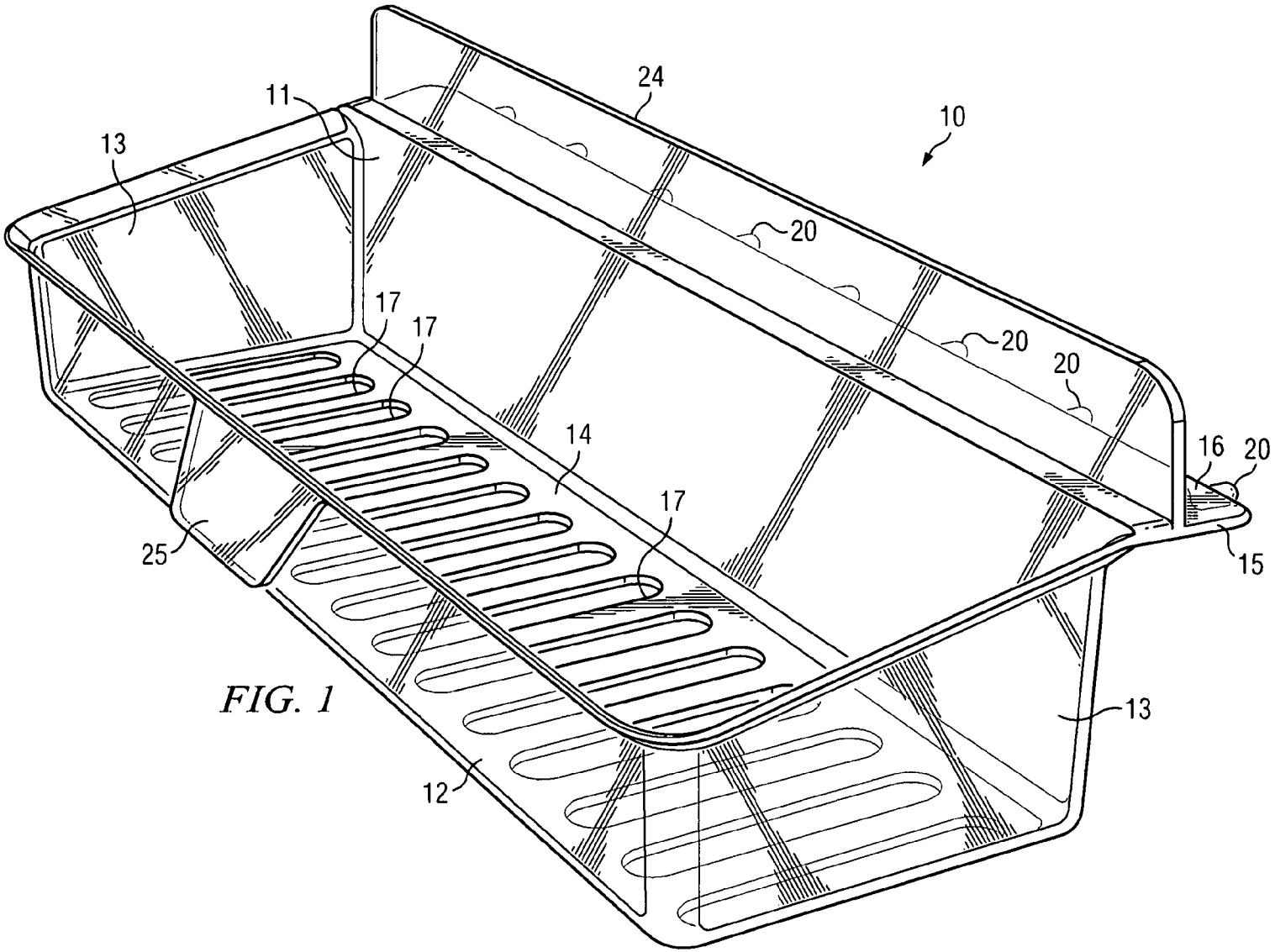
FIG. 1 is a top front perspective view of a preferred embodiment of the display tray of the invention.
Figure 2:
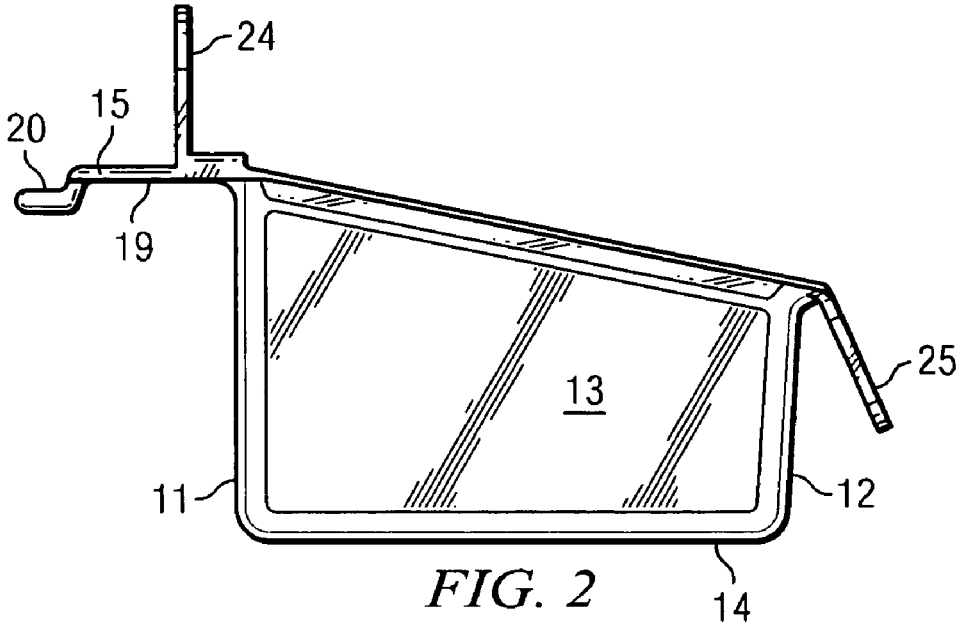
FIG. 2 is an elevational view of the left-hand end of the display tray of FIG. 1.

The above-described drawing is incorporated into and forms part of the specification to illustrate exemplary embodiments of the present invention. Throughout the drawing, like reference numerals designate corresponding elements. The figures are not to scale but are intended to disclose the inventive concepts by illustration. The drawing is not to be construed as limiting the invention to the illustrated and described examples.

It will be recognized that the principles of the invention may be utilized and embodied in many and various forms. In order to demonstrate these principles, the invention is described herein by reference to specific preferred embodiments. The invention, however, is not limited to the forms illustrated and described. Furthermore, the invention is not limited to use in connection with any particular arrangement of shelves but may find utility in various other applications involving support and display of various items.

For purposes of this disclosure, the term "shelf" is used herein to mean any substantially flat structure having a floor on which products or packages containing products may be placed or suspended from for display. The term "tray" is used to describe a structure which has a floor on which goods may be placed (or from which goods may be suspended) for display. Such floors may be formed of any suitable materials and may be continuous structure or may be formed of perforated or slotted members. Such trays may have walls extending upwardly or downwardly to form cavities in which goods may be supported and displayed. Accordingly, the tray may define one or more cavities above the floor or the floor may support one or more cavities which depend downwardly from the floor. Similarly, the floor may have slots, hooks or the like from which goods may be suspended. Accordingly, the term "tray" is used broadly to describe any structure on, in or from which goods may be placed or suspended for display.

For perspective and consistency in describing the display tray illustrated, the portion of the tray unit which is closest the shelf on which it is supported is described as the back or rear and the portion most remote from the supporting shelf is described as the front. Similarly, spatial orientation and relative terms such as "upwardly," "downwardly," "rearwardly," "horizontally," "above," "below," "upper," "lower" and the like are used in reference to the position of the tray when the tray is mounted on a supporting shelf for use.

The embodiment illustrated comprises a display tray 10 having a back wall 11, a front wall 12, end walls 13 and a floor 14. The display tray 10 is supported by a mounting panel or support means 15 which comprises a first member 16 attached to and extending from the back wall 11 and a plurality of connection posts 20. The first member 16 has a bottom face 19 which lies in a substantially horizontal plane substantially normal to the back wall 11 (parallel with the plane of the floor 14). A plurality of second members, preferably in the form of studs or posts 20, depend from and extend rearwardly from first member 16 (away from back wall 11). Each post 20 depends from and extends substantially parallel with (but horizontally displaced from) bottom face 19 of first member 16. The top surface 22 of each post 20 lies in a horizontal plane spaced from the horizontal plane of bottom face 19 a distance substantially equal to the vertical thickness of the display shelf on which it is to be mounted.

Figure 4:
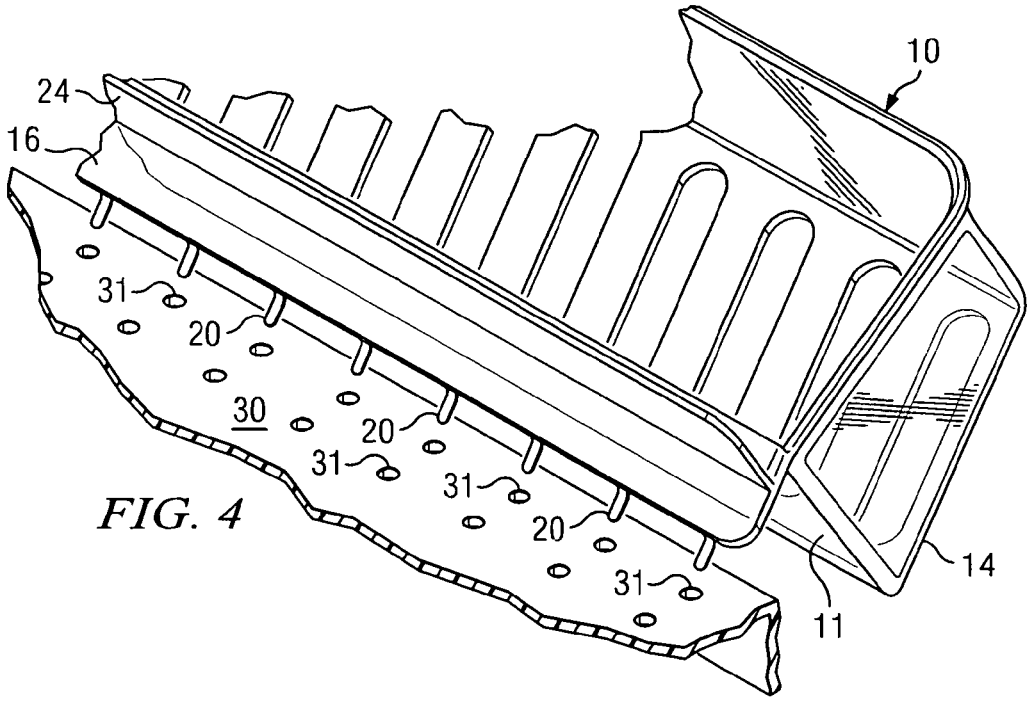
FIG. 4 is a perspective view of the front edge portion of a display shelf and the tray of FIG. 1 illustrating the method of mounting the tray on the shelf.
Figure 5:
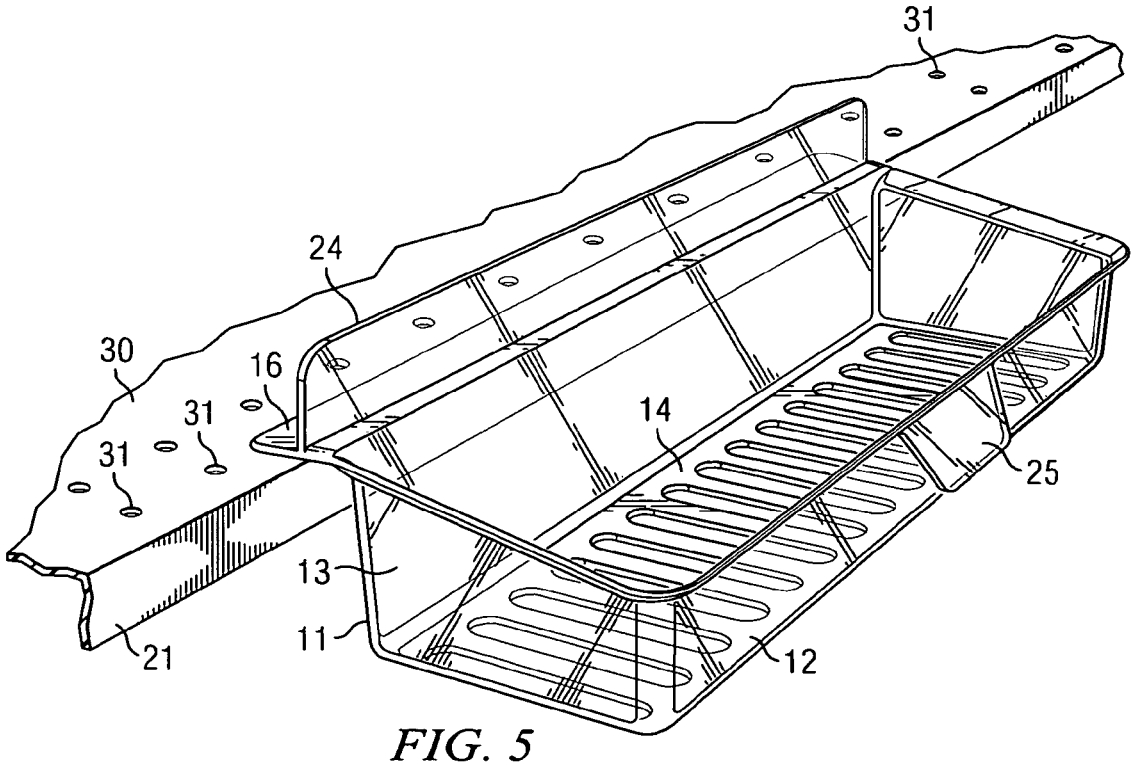
FIG. 5 is a top front perspective view of the display tray of FIG. 1 mounted on a display shelf.

As illustrated in FIGS. 4 and 5, conventional display shelves 30 usually include one or more rows of holes 31. At least one row extends parallel with and is spaced from the front edge 21. The holes 31 are ordinarily ¼ inch diameter holes on one inch centers. The first row of holes is approximately one inch from the front edge of the shelf and the thickness of the shelf 30 is usually about ⅛ to about 1/16 inch. Although these dimensions may vary from one shelf manufacturer to another, the sizing, arrangement and spacing of posts 20 may readily be varied to accommodate variations among standard dimensions of manufactured shelving. Accordingly, the dimensions of posts 20 should be sized to fit in holes 31 and the vertical spacing between top surface 22 of each post 20 and the bottom face 19 of first member 16 should be appropriately sized so that the posts 20 may be inserted into holes 31 and the top surfaces 22 of posts 20 rest against the bottom surface of display shelf 30 and support the tray 10 adjacent the front edge 21 of tray 10 as illustrated in FIG. 5.

Figure 3:
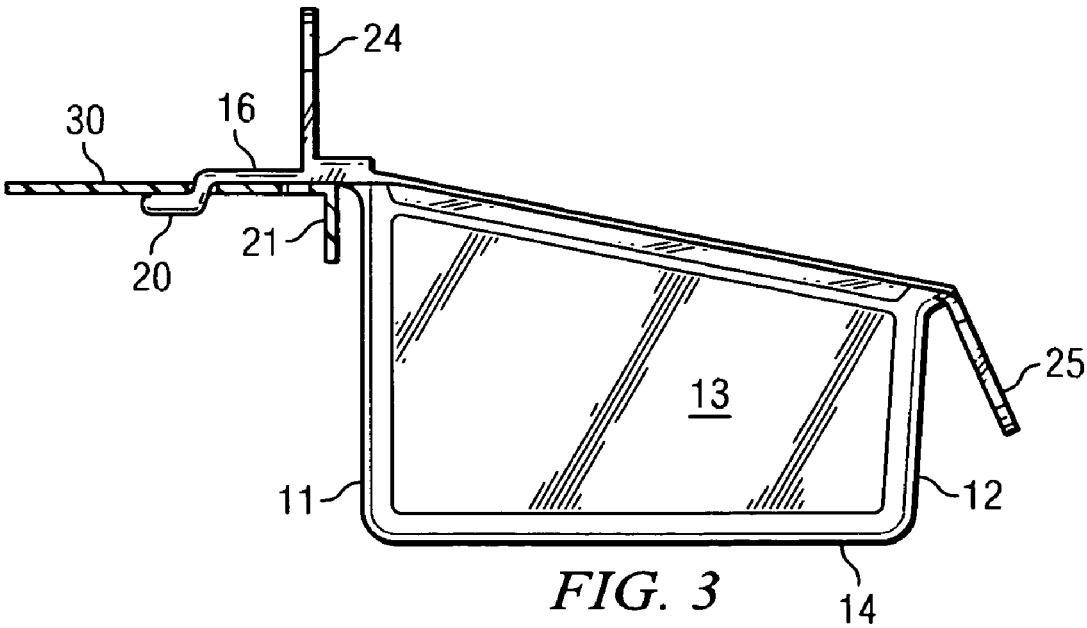
FIG. 3 is an elevational view of the left-hand end of the display tray of FIG. 1 mounted on a display shelf shown in cross-section.

A tray 10 with support structure 15 as described above may be easily attached to the front edge of shelf 30 by simply rotating and positioning the tray 10 so that the ends of posts 20 are vertically aligned with holes 31 (see FIG. 4); inserting the posts 20 through the holes 31; and then rotating the tray 10 90° so that posts 20 extend along and rest in contact with the bottom surface of shelf 30. In this position the bottom face 19 of first member 16 rests on the top surface of shelf 30 and the top surfaces 22 of posts 20 rest on the bottom surface of shelf 30. The tray 10 is thus firmly suspended from the front edge of the shelf 30 as shown in FIG. 3.

In the embodiment illustrated, the back walls 11 of tray 10 is suspended directly in front of front edge 21 of shelf 30 and thus obstructs the view of any information (such as price, etc.) or other graphic displayed thereon. To obviate this inconvenience, tray 10 may be provided with an upstanding flange or lip 24 which provides an alternate surface for displaying such information. The lip 24 may be any desired shape or size and is preferably positioned immediately above the front edge 21 as illustrated in FIG. 3. Lip 24 may also be shaped and positioned for use as a front wall which retains goods displayed on shelf 30.

To provide a surface for display of information or graphics relative to the goods displayed in the tray 10, a tab 25 may be formed on or attached to the front wall 12 or any other convenient location on the tray 10. In the preferred embodiment, tab 25 depends downwardly and outwardly from the top edge of front wall 12. Alternatively, the tab 25 may be formed as an integral portion of front wall 12 or positioned at any appropriate location.

As noted above, the tray of the invention may take various forms. For example, the embodiment illustrated comprises a distinct back wall 11, front wall 12, end walls 13 and floor 14 to define a tray cavity. As illustrated, the floor 14 includes a plurality of parallel slots 17. The tray of the invention, however, need not include front or back walls and need not include end walls. The tray may, for example, be in the form of a floor with one or more depressions or cavities therein. Furthermore, the tray need not be formed of solid walls or floors. These structures may be, for example, slotted (as shown in floor 14), perforated or similar structures. Similarly, the floor may be formed as or include hooks or other structure from which goods may be suspended. Accordingly, in its simplest form the tray may comprise a floor and support means such as the support means 15 illustrated and described.

The tray and support structure of the invention may readily be fabricated from any of various suitable materials. In the preferred embodiments the structures are formed of molded plastics, acrylics or the like to form unitary transparent, translucent or tinted bodies. Obviously, various other materials and manufacturing technologies may be used as desired. Furthermore, it will be appreciated that the tray need not be in the form of a rectangular basket structure as illustrated. It is only necessary that the tray of the invention include a floor which is supportable on a substantially horizontal shelf by support means which maintains the floor in a fixed position substantially parallel with and forming an extension of the shelf on which it is supported.

From the foregoing it will be recognized that the principles of the invention may be employed in various arrangements to obtain the benefit of the many advantages and features disclosed. It is to be understood, therefore, that even though numerous characteristics and advantages of the invention have been set forth together with details of the structure and function of the invention, this disclosure is to be considered illustrative only. Various changes and modifications may be made in detail, especially in matters of size, shape and arrangements and combinations of parts, without departing form the spirit and scope of the invention as defined by the appended claims.

What is claimed:

1. A unitary molded display tray comprising:
(a) a substantially horizontally extending floor;
(b) support means comprising
  (i) a first member having a bottom surface lying in a first plane vertically spaced from said floor and extending substantially horizontally and rearwardly from said floor and
  (ii) a plurality of second members, each depending from said bottom surface and extending rearwardly from said first member with a top surface thereof lying in a second plane spaced from and substantially parallel with said first plane;
(c) a back wall depending from said support means and supporting said floor; and
(d) a front wall and end walls which cooperate with said floor to define a cavity.

2. A unitary molded display tray as defined in claim 1 including a flange extending substantially vertically from said support means.

3. A unitary molded tray as defined in claim 1 including a tab positioned on said front wall for supporting a graphic display.

4. A unitary molded display tray as defined in claim 1 wherein said back wall defines an upper edge and said first member of said support means extends horizontally and rearwardly from said upper edge.

5. In combination:
(a) a display shelf with a substantially flat surface lying in a substantially horizontal plane having a front edge and a plurality of holes passing through said shelf with said holes aligned in a row extending substantially parallel with said front edge; and
(b) a unitary molded display tray comprising;
  (i) a floor having a surface lying in a plane substantially parallel with the surface of said shelf;
  (ii) support means comprising a first member having a bottom surface resting on the top face of said shelf and a plurality of posts extending from said bottom surface, extending through said holes, and contacting the bottom surface of said shelf;
  (iii) a back wall depending from said support means and supporting said floor; and
  (iv) a front wall and end walls which cooperate with said floor to define a cavity.

6. A combination as defined in claim 5 wherein said unitary molded display tray includes a flange extending substantially vertically from said support means.

7. A combination as defined in claim 5 including a tab positioned on said front wall for supporting a graphic display.

8. A combination as defined in claim 5 wherein said back wall defines an upper edge and said first member of said support means extends horizontally and rearwardly from said upper edge.

* * * * *